US007641066B2

(12) United States Patent
Baltz

(10) Patent No.: US 7,641,066 B2
(45) Date of Patent: Jan. 5, 2010

(54) COLLAPSIBLE CONTAINER

(75) Inventor: Kyle L. Baltz, Redondo Beach, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 310 days.

(21) Appl. No.: 11/761,222

(22) Filed: Jun. 11, 2007

(65) Prior Publication Data

US 2008/0302791 A1 Dec. 11, 2008

(51) Int. Cl.
*B65D 6/00* (2006.01)
*B65D 8/14* (2006.01)

(52) U.S. Cl. ..... 220/7; 220/6

(58) Field of Classification Search ..... 220/4.28, 220/6, 7; 206/600
See application file for complete search history.

(56) References Cited

U.S. PATENT DOCUMENTS

| | | | |
|---|---|---|---|
| 1,689,217 | A | 10/1928 | White |
| 1,809,523 | A | 6/1931 | McLean |
| 2,134,875 | A | 11/1938 | Henze |
| 2,760,669 | A | 8/1956 | Kreutzer |
| 3,220,603 | A | 11/1965 | Bromley |
| 3,360,180 | A | 12/1967 | Venturi |
| 3,446,415 | A | 5/1969 | Bromley |
| 3,591,212 | A | 7/1971 | Rhyne |
| 3,853,238 | A | 12/1974 | Luisada et al. |
| 3,874,546 | A | 4/1975 | Sanders et al. |
| 3,951,265 | A | 4/1976 | Carroll |
| 4,106,623 | A | 8/1978 | Carroll |
| 4,109,791 | A | 8/1978 | Clipson et al. |
| 4,148,407 | A | 4/1979 | Sinclair |
| 4,241,831 | A | 12/1980 | Locatelli |
| 4,247,004 | A | 1/1981 | Bird |
| 4,391,369 | A | 7/1983 | Stahl et al. |
| 4,423,813 | A | 1/1984 | Kreeger et al. |
| 4,466,541 | A | 8/1984 | Tabler et al. |
| 4,573,577 | A | 3/1986 | Miller |
| 4,591,065 | A | 5/1986 | Foy |
| RE32,223 | E | 8/1986 | Kreeger et al. |
| 4,643,310 | A | 2/1987 | Deaton |
| 4,735,330 | A | 4/1988 | Hoss |
| 4,759,451 | A | 7/1988 | Apps |
| 4,848,578 | A | 7/1989 | Schafer |
| 4,863,062 | A | 9/1989 | Holliday |
| 4,887,874 | A | 12/1989 | Joffe |

(Continued)

FOREIGN PATENT DOCUMENTS

| | | |
|---|---|---|
| CA | 2309234 | 11/2000 |

(Continued)

OTHER PUBLICATIONS

United Kingdom Search Report for UK Patent Application No. GB0810452.3, Aug. 21, 2008.

*Primary Examiner*—Harry A Grosso
(74) *Attorney, Agent, or Firm*—Carlson, Gaskey & Olds

(57) ABSTRACT

A collapsible container with latches provides a more consistent knockdown force in more situations. At least one of the engaging surfaces of the latch is curved outwardly toward the other engaging surface. This provides substantially tangential contact between the surfaces, even when the wall is deformed slightly by the knockdown force. The tangential contact provides consistent frictional force resisting the knockdown force.

25 Claims, 13 Drawing Sheets

U.S. PATENT DOCUMENTS

| | | | |
|---|---|---|---|
| 4,901,859 | A | 2/1990 | Jones |
| 4,905,833 | A | 3/1990 | Kreeger et al. |
| 4,917,255 | A | 4/1990 | Foy et al. |
| 4,923,079 | A | 5/1990 | Foy |
| 4,947,992 | A | 8/1990 | Schafer |
| 4,960,223 | A | 10/1990 | Chiang et al. |
| 5,083,666 | A | 1/1992 | Lam |
| 5,094,356 | A | 3/1992 | Miller |
| 5,161,709 | A | 11/1992 | Oestreich, Jr. |
| 5,332,114 | A | 7/1994 | Sano et al. |
| 5,398,834 | A | 3/1995 | Umiker |
| 5,398,835 | A | 3/1995 | Blinstrub |
| 5,467,885 | A | 11/1995 | Blinstrub |
| 5,494,163 | A | 2/1996 | Apps |
| 5,515,987 | A | 5/1996 | Jacques et al. |
| 5,586,675 | A | 12/1996 | Borsboom et al. |
| 5,588,549 | A | 12/1996 | Furtner |
| 5,609,254 | A | 3/1997 | Loftus |
| 5,632,392 | A | 5/1997 | Oh |
| D381,203 | S | 7/1997 | Ackermann |
| 5,671,857 | A | 9/1997 | Stromberg |
| 5,772,033 | A | 6/1998 | Loftus |
| 5,797,508 | A | 8/1998 | Loftus et al. |
| 5,853,099 | A | 12/1998 | Lessard |
| 5,860,527 | A | 1/1999 | Frankenberg et al. |
| 5,924,572 | A | 7/1999 | Cope |
| 5,975,324 | A | 11/1999 | Schmitt |
| 6,015,056 | A | 1/2000 | Overholt |
| 6,029,840 | A | 2/2000 | Brauner |
| 6,056,177 | A | 5/2000 | Schneider |
| 6,059,114 | A | 5/2000 | Loftus |
| 6,073,790 | A | 6/2000 | Umiker |
| 6,082,570 | A | 7/2000 | Tai |
| 6,098,827 | A | 8/2000 | Overholt et al. |
| 6,142,329 | A | 11/2000 | Dotan |
| 6,179,156 | B1 | 1/2001 | Aiken |
| 6,209,742 | B1 | 4/2001 | Overholt et al. |
| D446,392 | S | 8/2001 | Overholt et al. |
| 6,286,701 | B1 | 9/2001 | Umiker |
| 6,290,081 | B1 | 9/2001 | Merey |
| 6,293,418 | B1 | 9/2001 | Ogden et al. |
| D452,614 | S | 1/2002 | Overholt |
| 6,382,458 | B2 | 5/2002 | Mori |
| 6,386,388 | B1 | 5/2002 | Overholt |
| D458,753 | S | 6/2002 | Overholt et al. |
| 6,398,054 | B1 | 6/2002 | Overholt et al. |
| 6,405,888 | B1 | 6/2002 | Overholt et al. |
| 6,409,041 | B1 | 6/2002 | Overholt et al. |
| 6,446,825 | B1 | 9/2002 | Godoy |
| 6,581,330 | B1 | 6/2003 | Helsloot et al. |
| 6,722,516 | B1 | 4/2004 | Zelko |
| 6,772,897 | B2 | 8/2004 | Kellerer et al. |
| 6,820,761 | B1 | 11/2004 | Mouri et al. |
| 6,863,180 | B2 | 3/2005 | Apps et al. |
| 6,994,216 | B2 | 2/2006 | Wong |
| 7,017,766 | B2 | 3/2006 | Hsu et al. |
| 7,195,128 | B2 | 3/2007 | Murakami et al. |
| 2002/0108950 | A1 | 8/2002 | Moorman et al. |
| 2003/0000950 | A1 | 1/2003 | Murakami et al. |
| 2003/0132228 | A1 | 7/2003 | Apps et al. |
| 2003/0222081 | A1 | 12/2003 | Apps et al. |
| 2004/0069780 | A1 | 4/2004 | Apps et al. |
| 2004/0129700 | A1 | 7/2004 | Oster et al. |
| 2005/0040166 | A1 | 2/2005 | Nolet et al. |
| 2005/0098556 | A1 | 5/2005 | Kellerer |

FOREIGN PATENT DOCUMENTS

| | | |
|---|---|---|
| DE | 1536040 | 10/1966 |
| DE | 2033724 | 7/1970 |
| DE | 3511321 | 10/1986 |
| DE | 3521894 | 1/1987 |
| DE | 9103975 | 3/1991 |
| DE | 19939019 | 8/1998 |
| DE | 20002537 | 2/2000 |
| EP | 0073357 | 8/1982 |
| EP | 0299657 | 7/1988 |
| EP | 0341074 | 5/1989 |
| EP | 0385914 | 9/1990 |
| EP | 0404041 | 12/1990 |
| EP | 0690003 | 1/1996 |
| EP | 0705764 | 4/1996 |
| EP | 0785142 | 7/1997 |
| EP | 0962394 | 12/1999 |
| EP | 0962396 | 12/1999 |
| EP | 1114779 | 7/2001 |
| EP | 1160169 | 12/2001 |
| EP | 1182139 | 2/2002 |
| EP | 1241105 | 9/2002 |
| FR | 1040163 | 10/1953 |
| FR | 2701690 | 2/1993 |
| FR | 2702198 | 3/1993 |
| GB | 1215049 | 12/1970 |
| GB | 2068338 | 8/1981 |
| GB | 2129401 | 5/1984 |
| GB | 2139189 | 11/1984 |
| GB | 2141778 | 1/1985 |
| GB | 2171980 | 9/1986 |
| GB | 2431921 | 5/2007 |
| GB | 2431922 | 5/2007 |
| JP | 11222233 | 8/1999 |
| JP | 2001180670 | 7/2001 |
| JP | 2003020037 | 1/2003 |
| NL | 7905105 | 6/1979 |
| SU | 1533952 | 1/1990 |
| WO | 93/24378 | 12/1993 |
| WO | 97/49613 | 12/1997 |
| WO | 98/56668 | 12/1998 |
| WO | 00/27716 | 5/2000 |
| WO | 00/66440 | 11/2000 |
| WO | 02/06128 | 1/2002 |
| WO | 02/34630 | 5/2002 |
| WO | 03/104094 | 12/2003 |

COLLAPSIBLE CONTAINER

BACKGROUND OF THE INVENTION

The present invention relates generally to collapsible containers and more particularly to an improved latch for a collapsible container.

Collapsible containers are well known. Typically, four walls, each connected via a hinge to a base, are selectively moveable about the hinge between an upright use position in which the wall is generally perpendicular to the base and a collapsed position on the base. Various mechanisms have been provided to connect adjacent walls at the corners to selectively lock the container in the use position and selectively permit the collapse of the walls onto the base for transport or storage.

Generally, there are two kinds of collapsible containers. Some containers include latches at the corners that lock the walls in the upright position until the latch is selectively actuated to permit the movement of the walls to the collapsed position. Typically these latches are actuated manually by a user selectively deflecting the latch to permit movement of the walls. Other latches are optimized for actuation by automated equipment, which actuates the latch and collapses the container.

Another known type of collapsible container is the "knock-down" container. Often there is simply some sort of interference fit between a member on one wall with a complementary member on the adjacent wall. Thus, no actuation of a latch is required. The walls are forcibly moved into the upright position and can be forcibly knocked-down to the collapsed position without actuation of any latches. One disadvantage of the knock-down container is that the force required to lock the walls in the upright position may be much higher than normal latched containers because this is the same (or nearly the same) force that retains the walls in the upright position. In fact, knock-down containers often require the user to manually force the interference members together one-by-one.

U.S. Pat. No. 7,017,766, the assignee of which is the assignee of the present invention, provides a collapsible container for which the force required to move the walls to the upright position is as low as a typical latched collapsible container. The walls are also easily collapsed by actuating the latch mechanism but can also be knocked-down forcibly without actuating the latches. The collapsible container in that patent provides a latch protruding laterally from a first wall and engaging an adjacent second wall to retain the walls in an upright position. The latch is deflectable in a direction generally parallel to the plane of the first wall to selectively disengage the latch from the second wall. The latch and the second wall include complementary first ramped surfaces that engage one another to deflect the latch downwardly as the adjacent wall is raised to the upright position. The latch and the adjacent wall further both include second ramped surfaces that engage one another when the adjacent wall is in the upright position. The second ramp surfaces are much steeper than the first ramped surfaces, such that the force required to deflect the latch while moving the adjacent wall to the collapsed position is much greater than the force necessary to deflect the latch while moving the adjacent wall to the upright position.

Thus, the second wall in that patent can be moved to the collapsed position either by manually actuating the latch and applying a light force, or by knocking down the adjacent wall with a higher force causing the engagement of the second ramped surfaces on the second wall and latch thereby causing the latch to deflect and release the second wall.

The prior design works well in most instances; however, at times the latches require a knockdown force greater than would be desirable to disengage the latches.

SUMMARY OF THE INVENTION

The present invention provides a collapsible container with latches that provide a more consistent knockdown force in more situations. The improvements could be applied to a knockdown-only container or to a latch that is both manually releasable or a knockdown.

In order to provide a more consistent knockdown force requirement, at least one of the engaging surfaces of the latch is curved outwardly toward the other engaging surface. This provides substantially tangential contact between the surfaces, even when the wall is deformed slightly by the knockdown force. The tangential contact provides consistent frictional force resisting the knockdown force.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF A PREFERRED EMBODIMENT

Figure 1:
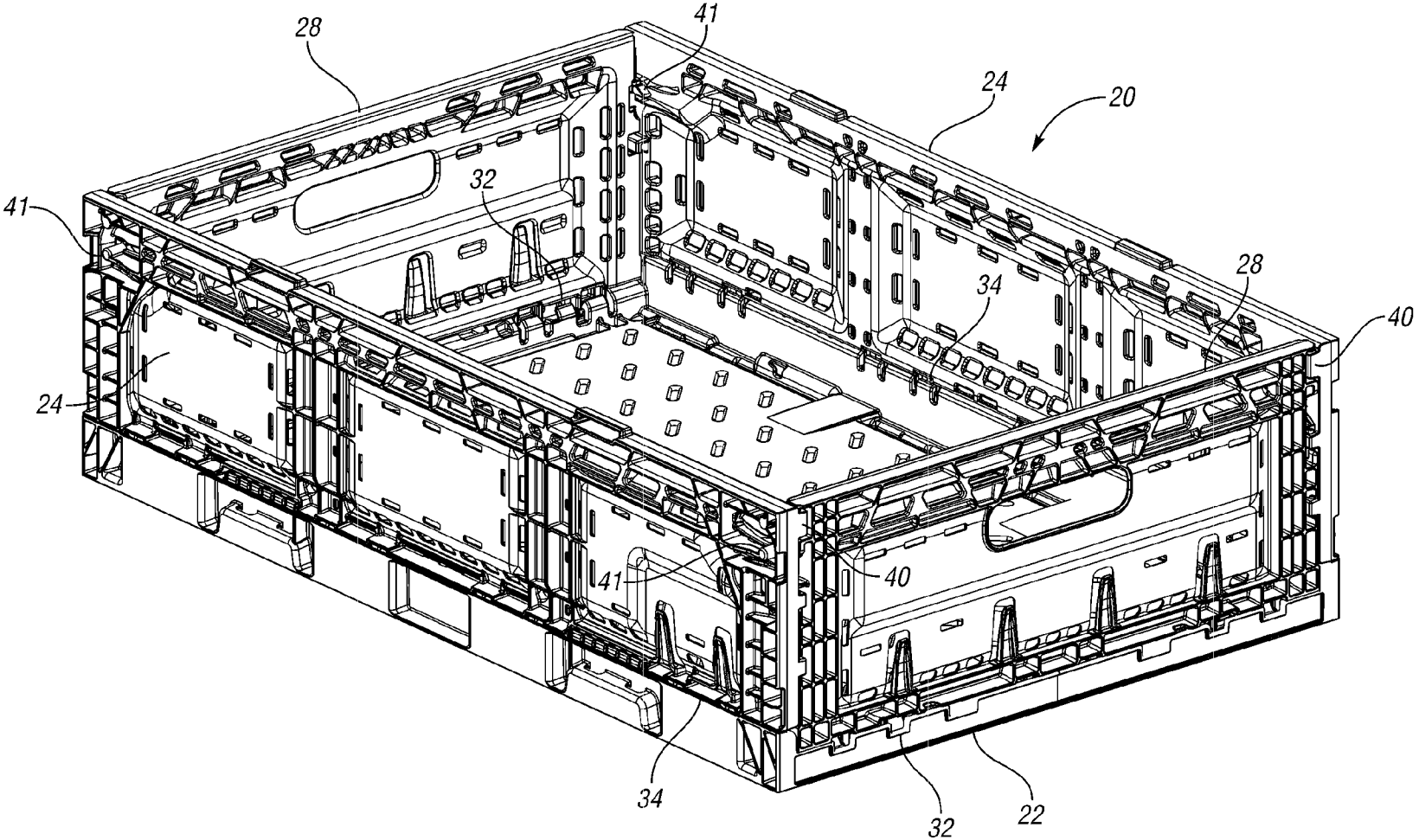
FIG. 1 is a perspective view of one embodiment of the collapsible container according to the present invention in the upright position.
Figure 2:
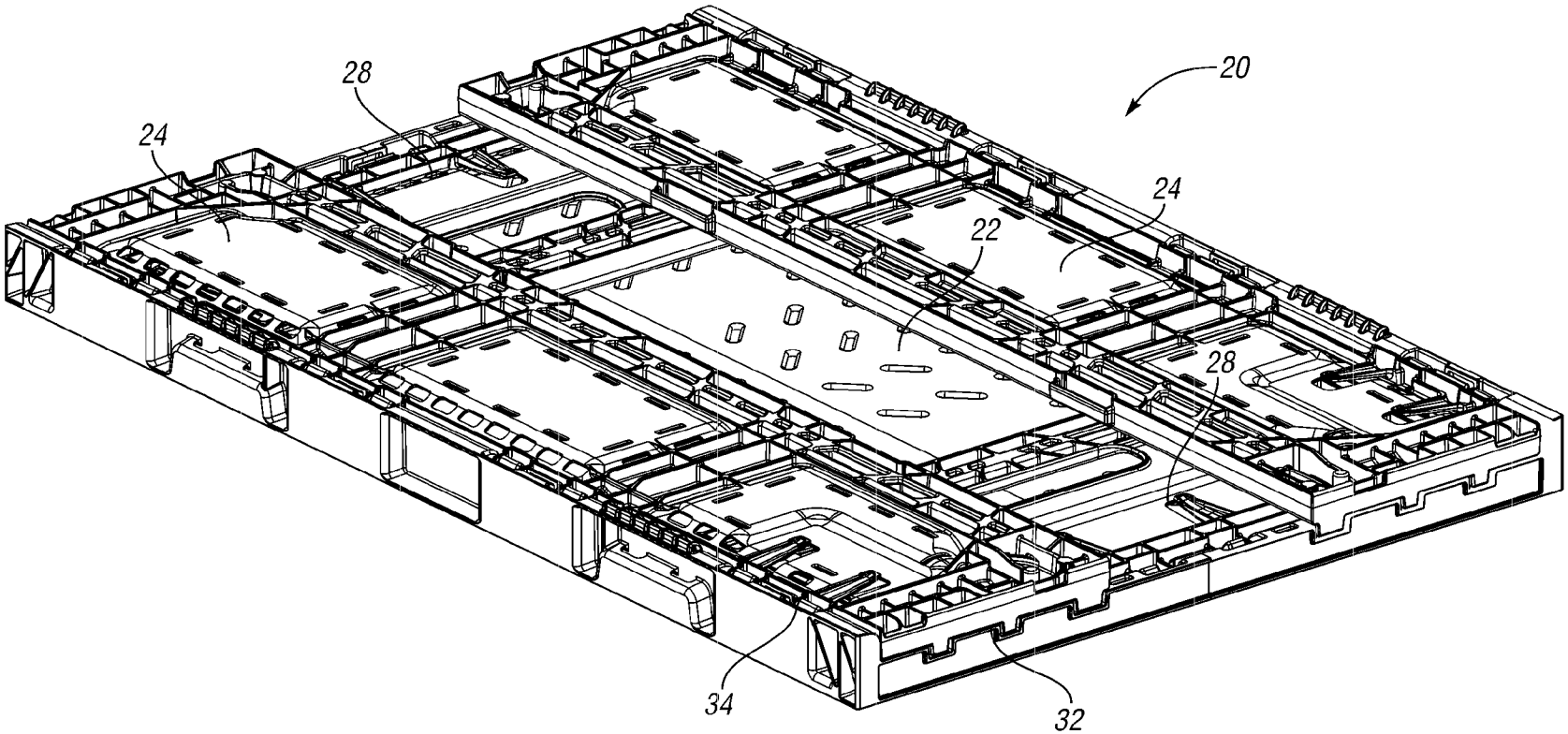
FIG. 2 is the collapsible container of FIG. 1 in the inwardly collapsed position.

One possible embodiment of the collapsible container 20 of the present invention is shown in FIG. 1. The collapsible container 20 includes a base 22, side walls 24, and end walls 28. As is known, the walls 24, 28 are moveable about hinges 32, 34 between an upright erect position, generally perpendicular to the base 22 (as shown in FIG. 1) to a collapsed position on the base 22, generally parallel to the base 22 (as shown in FIG. 2). Each side wall 24 includes two flange portions 40 extending perpendicular to the side wall 24 and engaging the end walls 28. The collapsible container 20 of the present invention provides improved latches 41 securing each side wall 24 to its adjacent end wall 28.

FIG. 2 shows the collapsible container 20 of FIG. 1 in the collapsed position, where the end walls 28 and the side walls 24 are collapsed onto the base 22, after pivoting about the hinges 32 and 34 to a position substantially parallel to the base 22.

Figure 3:
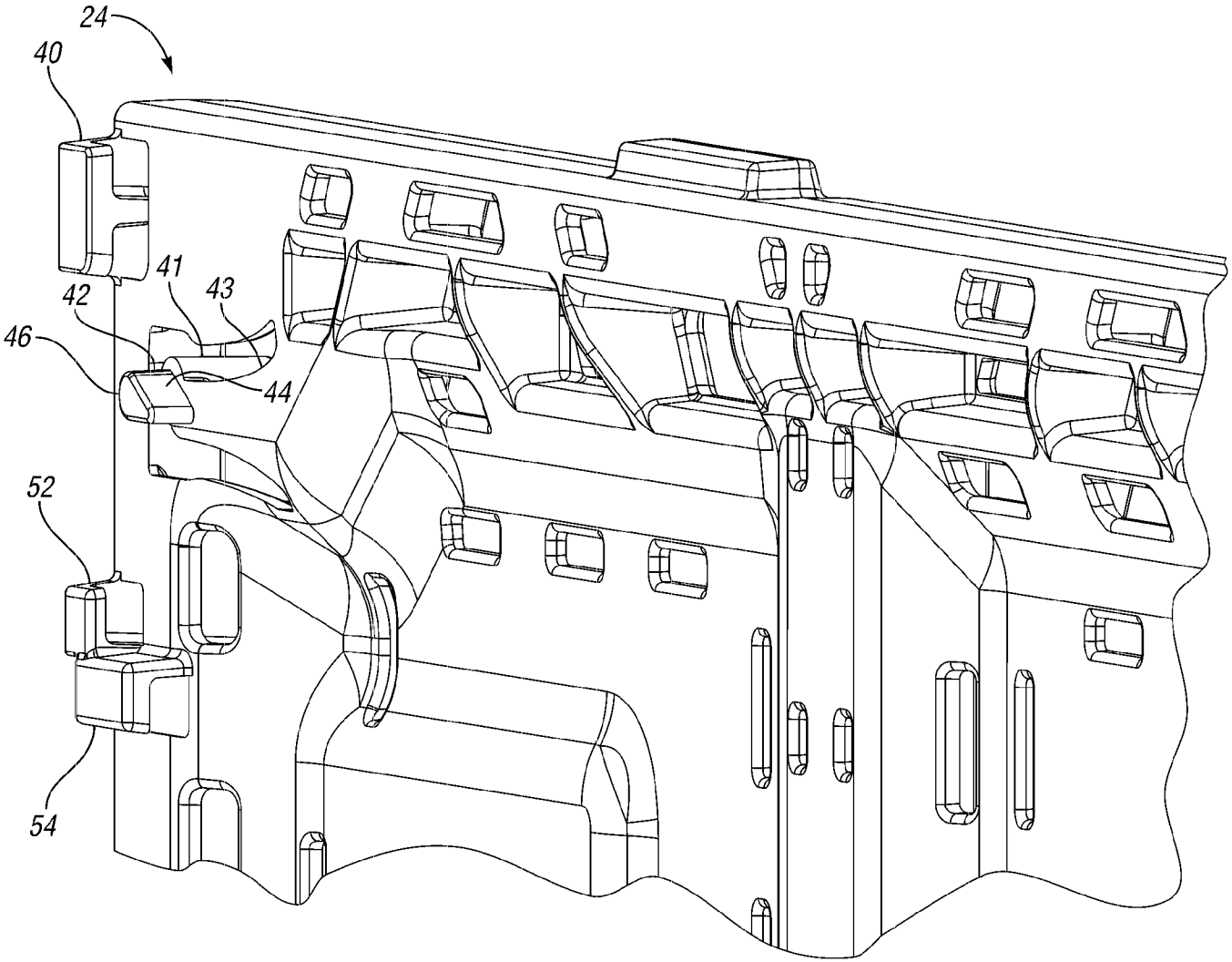
FIG. 3 is an enlarged, perspective, interior view of a latch on one of the side walls of the collapsible container of FIG. 1.

FIG. 3 is an enlarged interior view of one of the side walls 24 of collapsible container 20. At each end the side wall 24 includes a latch 41 which includes a teardrop-shaped latch member 42 protruding laterally from the end of a cantilevered flexible arm 43, all integrally molded with the side wall 24. The latch member 42 includes a first forward ramped surface 44 and a rearward, convex, second rounded surface 46. The first forward ramped surface 44 is sloped much more gradually than the second rounded surface 46. The side wall 24 further includes a T-interlock 50 on flange portion 40, a middle flange 52 and an L-shaped interlock 54, all protruding inwardly from the side wall 24.

Figure 4:
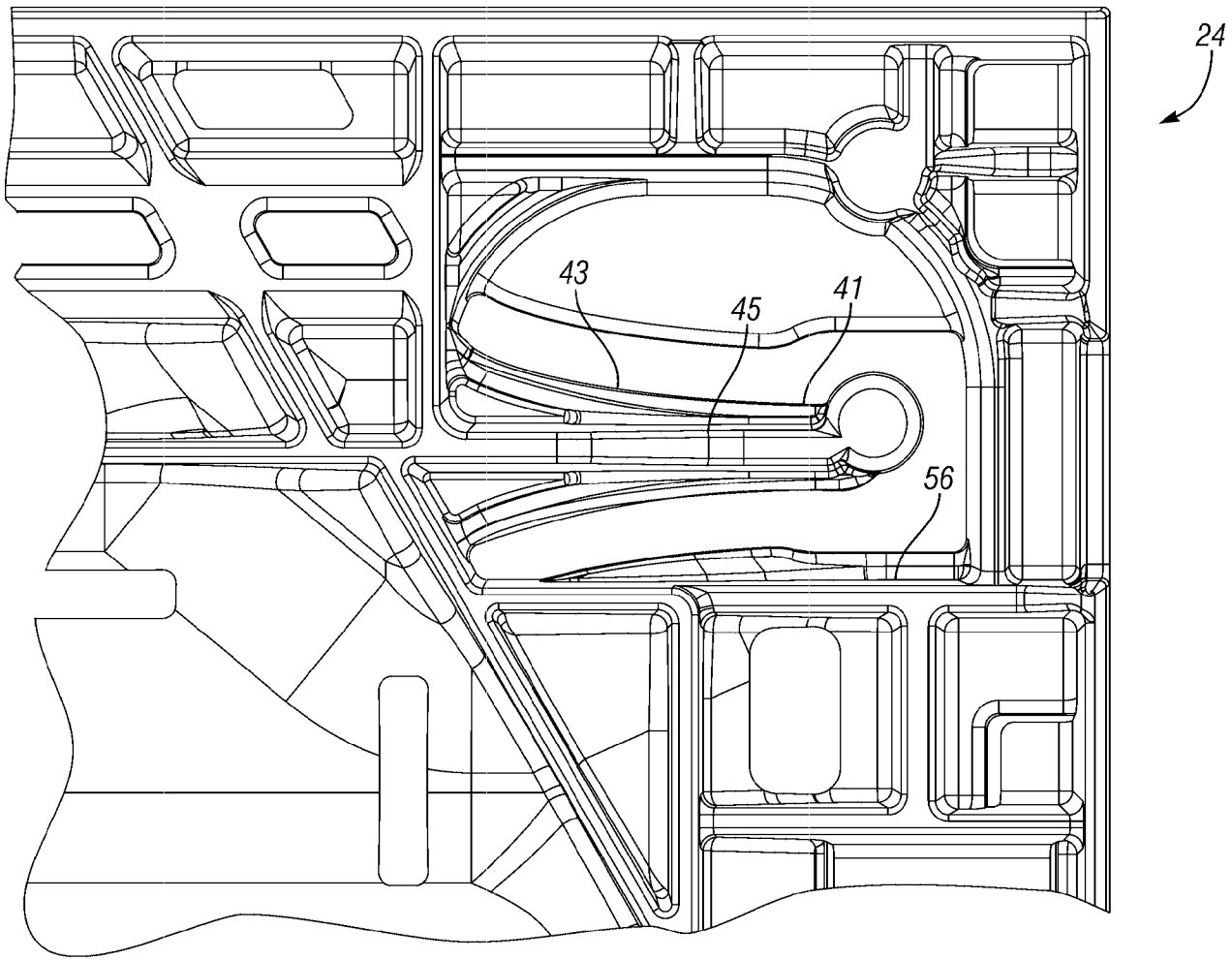
FIG. 4 is an exterior view of the latch of FIG. 3.

FIG. 4 illustrates an exterior view of the latch 41 of the side wall 24 of FIG. 3. As can be seen in FIG. 4, the latch 41 further includes a tab 45 formed on the exterior of the flexible arm 43 and protruding into a recess 56 formed on the exterior of the side wall 24.

Figure 5:
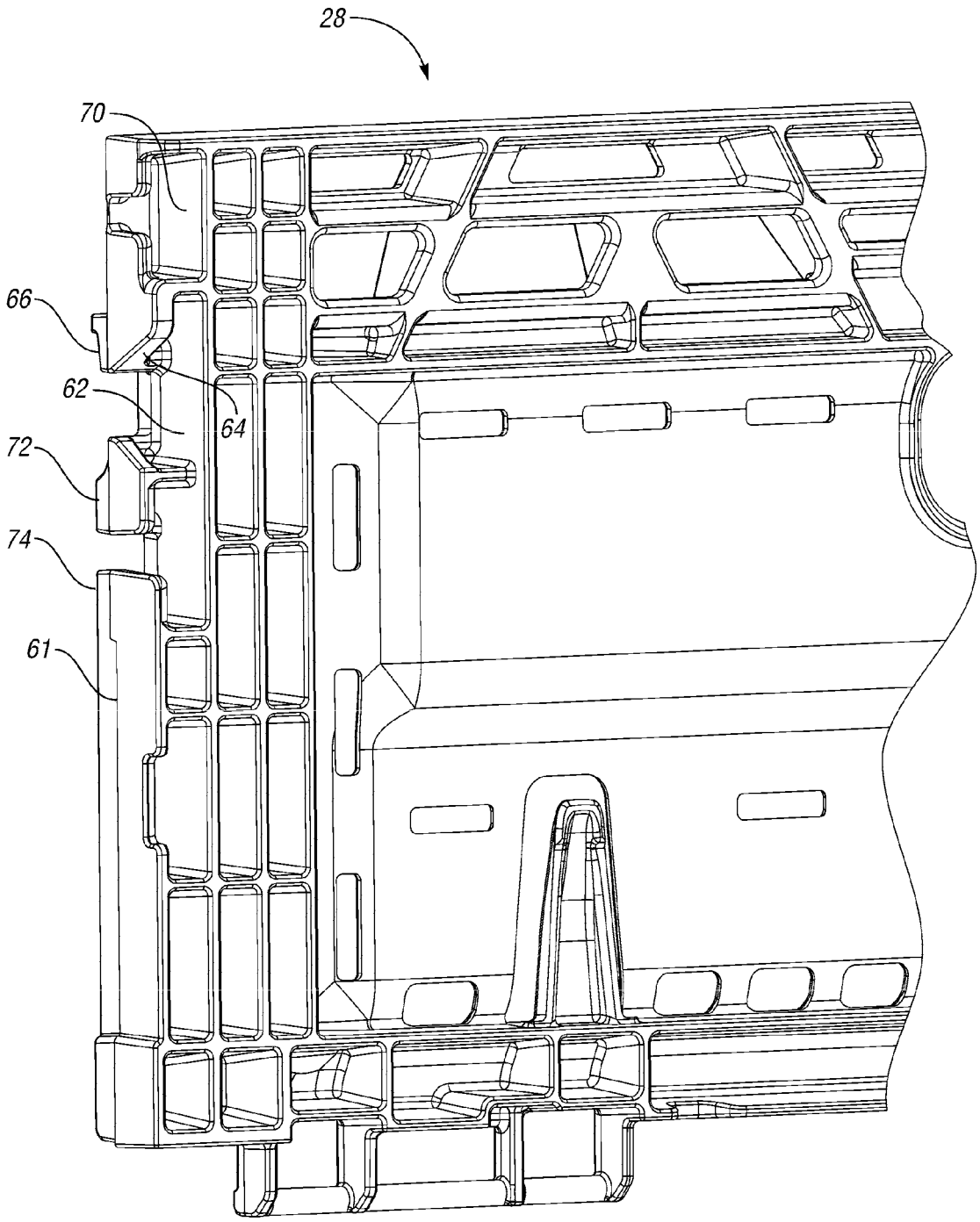
FIG. 5 is a perspective exterior view of one side edge of an end wall that engages the latch of FIG. 4.
Figure 6:
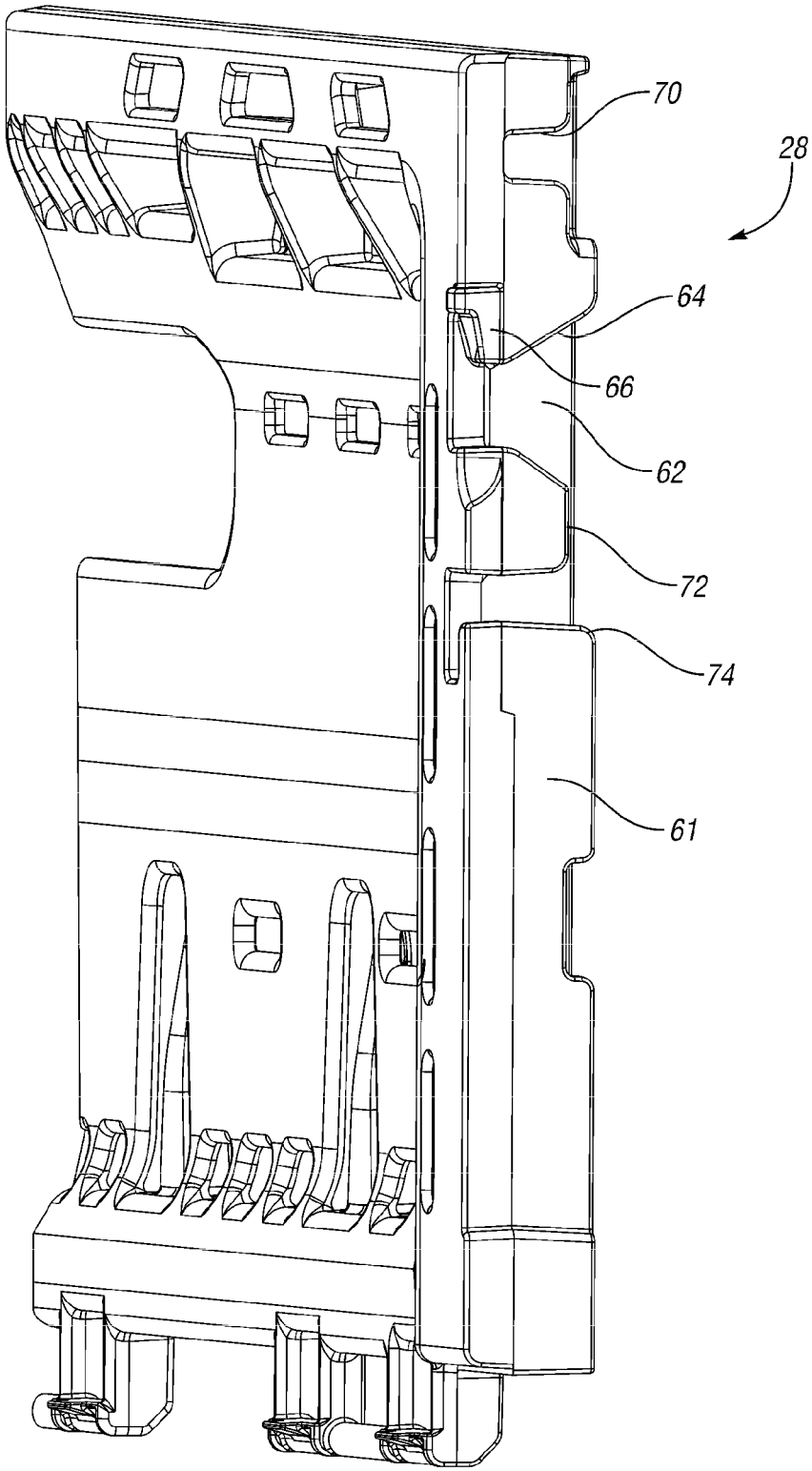
FIG. 6 is a perspective interior view of the side edge of the end wall of FIG. 5.

FIG. 5 is an exterior perspective view of the side edge 61 of the end wall 28 and FIG. 6 is an interior perspective view of the side edge 61. End wall 28 includes a side edge 61 into which is formed a recess 62. Adjacent recess 62, there is formed a first, forward ramp surface 64 and a second, rearward ramped surface 66. The second, rearward ramped surface 66 is substantially steeper than the first, forward ramped surface 64. Preferably the second, rearward ramped surface 66 is a few degrees less than perpendicular to the base 22. The side edge 61 of the end wall 28 further includes a T-interlock receiver 70 formed above the recess 62 and a flange 72 and an L-shaped interlock 74 formed below the recess 62.

Figure 7:
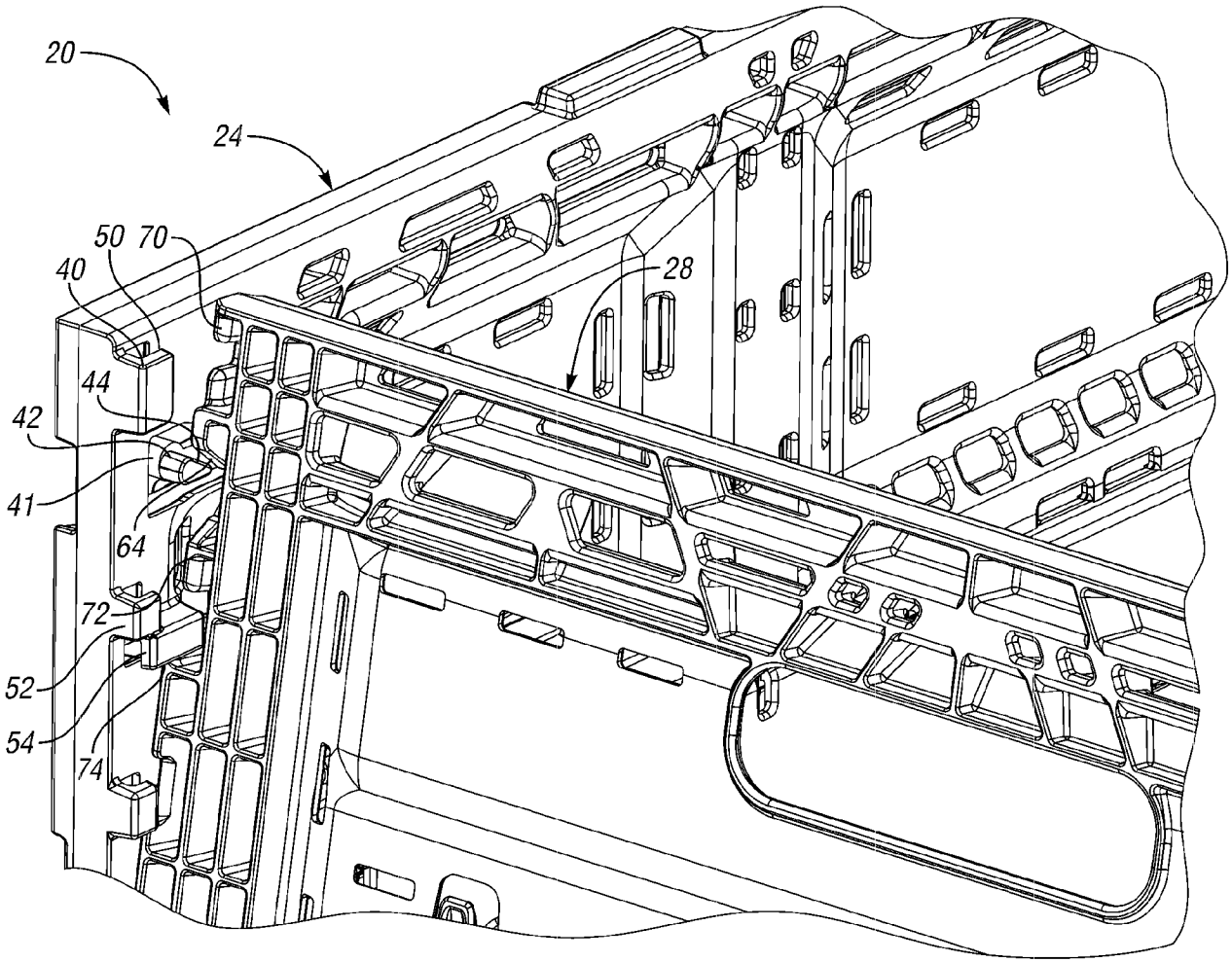
FIG. 7 shows the end wall of FIG. 5 as it is moved toward the upright position to connect to the side wall of FIG. 3.

FIG. 7 is an exterior perspective view of the side wall 24 and adjacent end wall 28, the side wall 24 in its upright use position and the end wall 28 being pivoted toward the upright use position. As can be seen in FIG. 7, as the end wall 28 is pivoted to its upright use position, the latch member 42 is aligned with the recess 62 on end wall 28. The T-interlock 70 is aligned with the T-interlock receiver 50, the L-shaped interlock 74 aligns with the L-shaped interlock 54 and the flange 72 aligns with the middle flange 52. The first, forward ramped surface 64 is aligned with and engages the first, forward ramped surface 44 on the latch member 42, thereby causing latch member 42 to deflect downwardly in a direction generally parallel to the plane of side wall 24 and generally transverse to the base 22 (not shown in FIG. 7).

Figure 8:
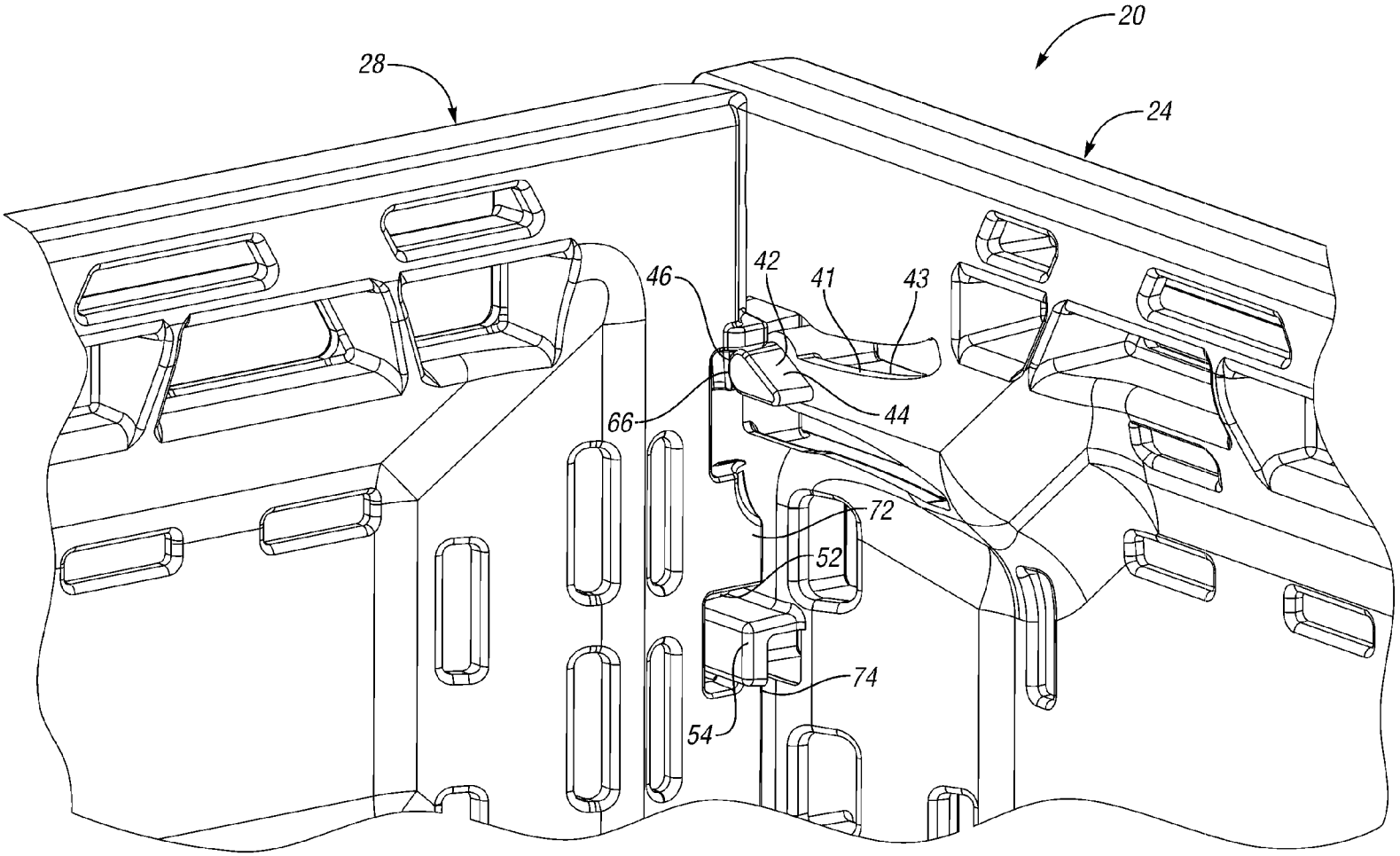
FIG. 8 is an interior view of the side wall and end wall of FIG. 7 in the fully upright, latched position.

FIG. 8 is an interior perspective view of the side wall 24 and the end wall 28 in the upright, use, latched position. In this position, the latch 41 is in its normal, undeflected position and the second rounded surface 46 of the latch member 42 abuts the second, rearward ramped surface 66 of the end wall 28, thereby securing the end wall 28 in its upright used position.

Figure 9:
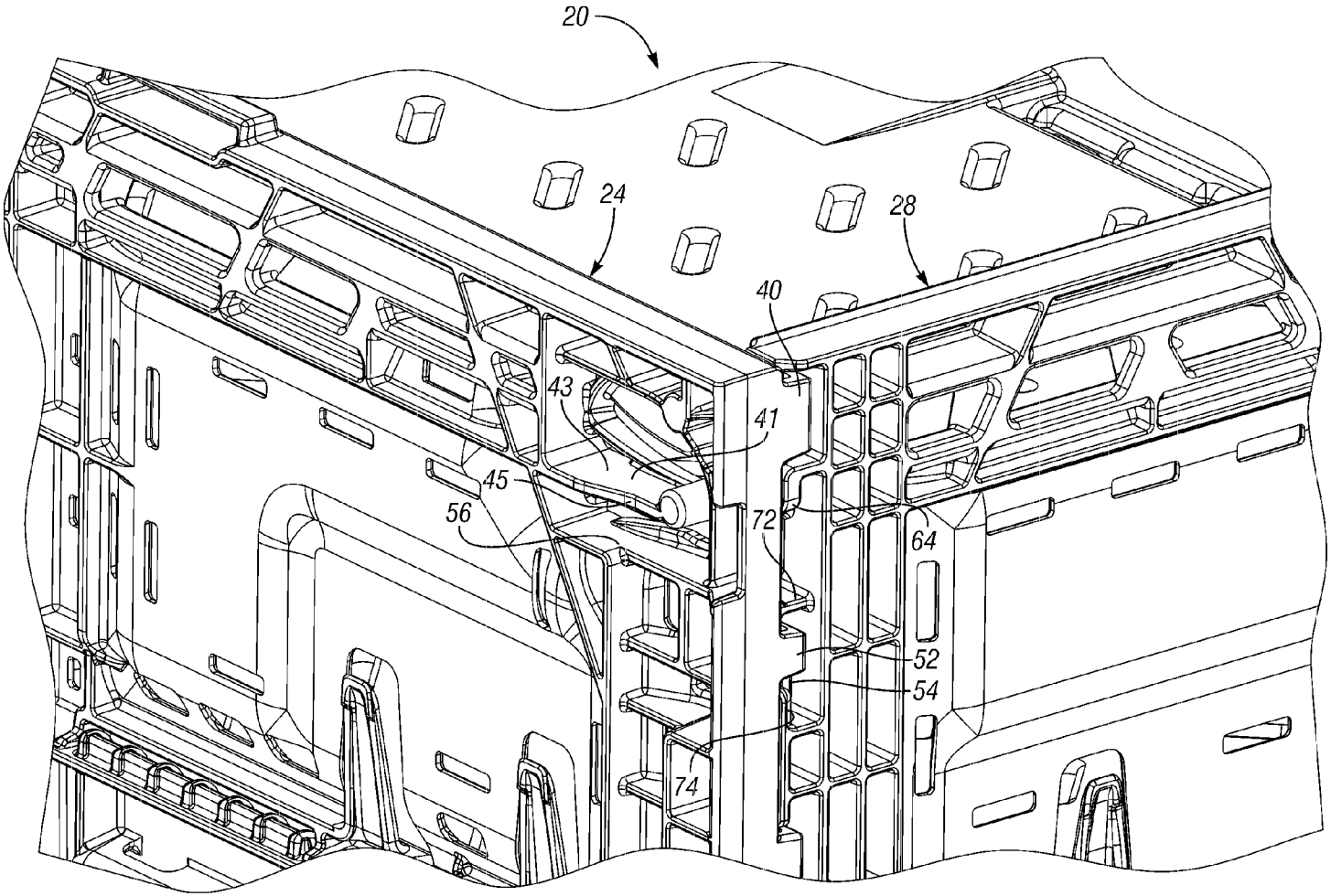
FIG. 9 is an exterior view of the side wall and end wall of FIG. 7.

FIG. 9 is an exterior perspective view of the side wall 24 and end wall 28 in the upright use, latched position. As can be seen in FIG. 9, the T-interlock 70 is received within the T-interlock receiver 50, the L-shaped interlock 74 is interlocked with the L-shaped interlock 54 and the flange 72 is interlocked with the middle flange 52. The tab 45 of the latch 41 is accessible through recess 56 in the side wall 24. The tab 45 can be manually depressed downwardly (toward the base 22 (not shown)) to deflect the latch 41 downwardly such that the second rounded surface 46 of the latch member 42 (FIG. 8) does not impede movement of the end wall 28 from the upright position to the collapsed position. The end wall 28 can also be "knocked down," that is, forcibly collapsed without first actuating latch 41 with tab 45. Referring to FIG. 8, if sufficient force is exerted inwardly on end wall 28, the engagement of the second, rearward ramped surface 66 with the second rounded surface 46 of latch member 42 will cause latch 41 to deflect downwardly, thereby releasing end wall 28 from the latch 41. The amount of force required to knock down end wall 28 will be substantially consistent even if the end wall 28 is deformed slightly by the knockdown force.

Figure 10:
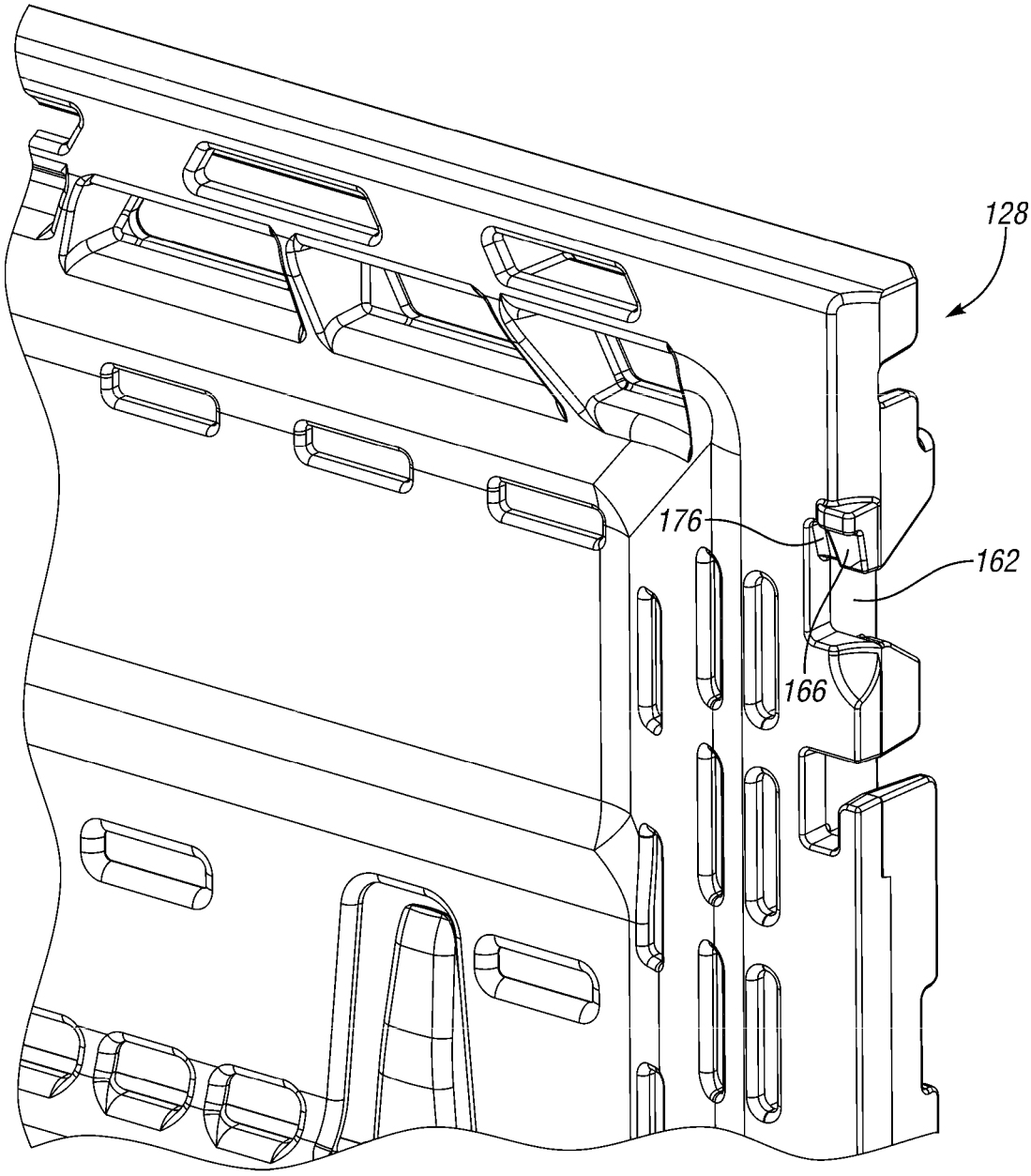
FIG. 10 is an interior perspective view of an alternate end wall that could be used in the container of FIGS. 1-9.

An interior perspective view of an alternate end wall 128 is shown in FIG. 10. The end wall 128 includes a rearward ramped surface 166 above the recess 162 and having an adjacent pocket 176 formed inward of the rearward ramped surface 166.

Figure 11:
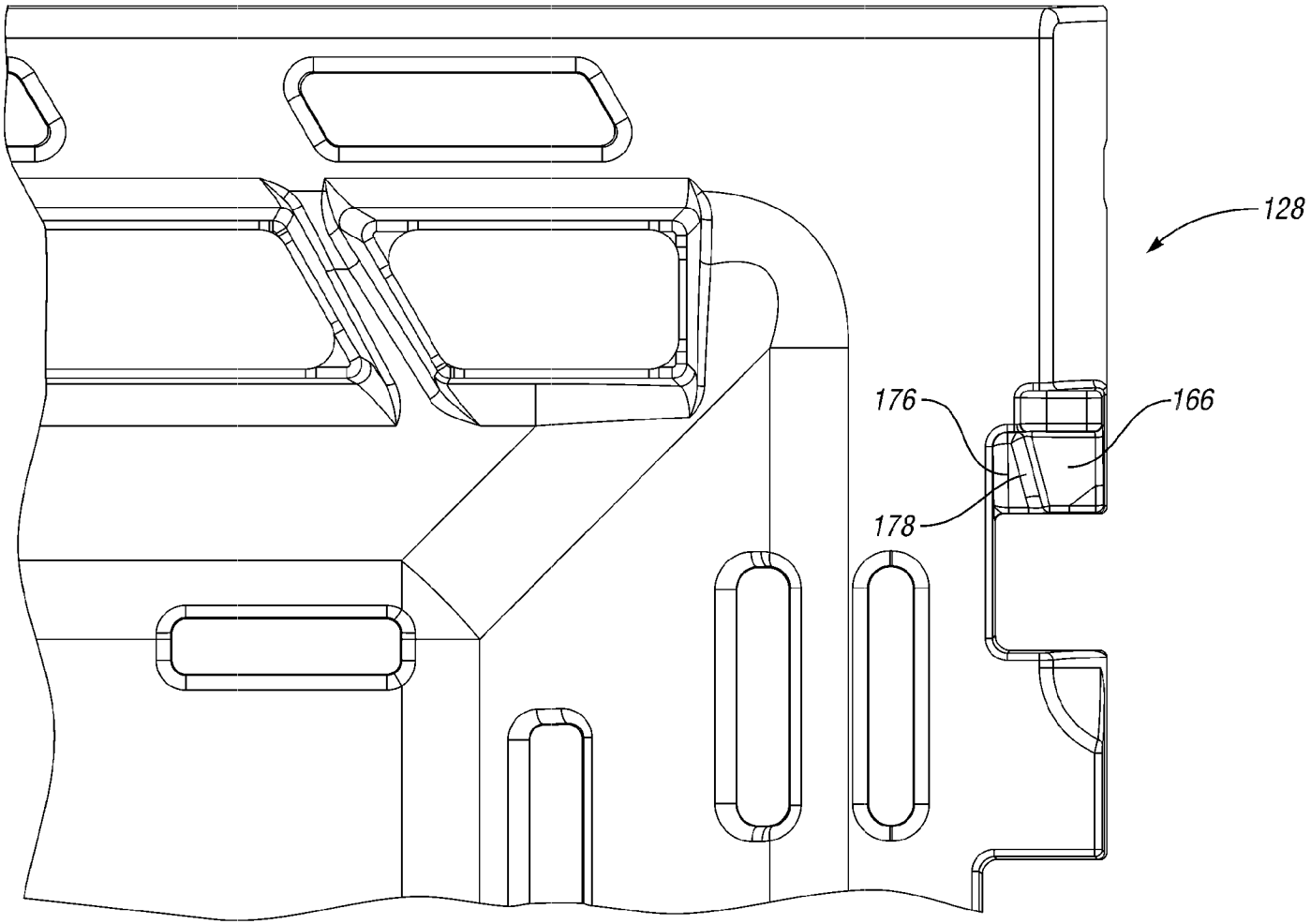
FIG. 11 is an enlarged interior view of a portion of the end wall of FIG. 10.

FIG. 11 is an enlarged interior view showing an angled, bevel surface 178 transitioning between the pocket 176 and the rearward ramped surface 166. The bevel surface 178 angles toward the side edge of the end wall 128 as it extends downwardly, such that the rearward ramped surface 166 is tapered at its lower end.

Figure 12:
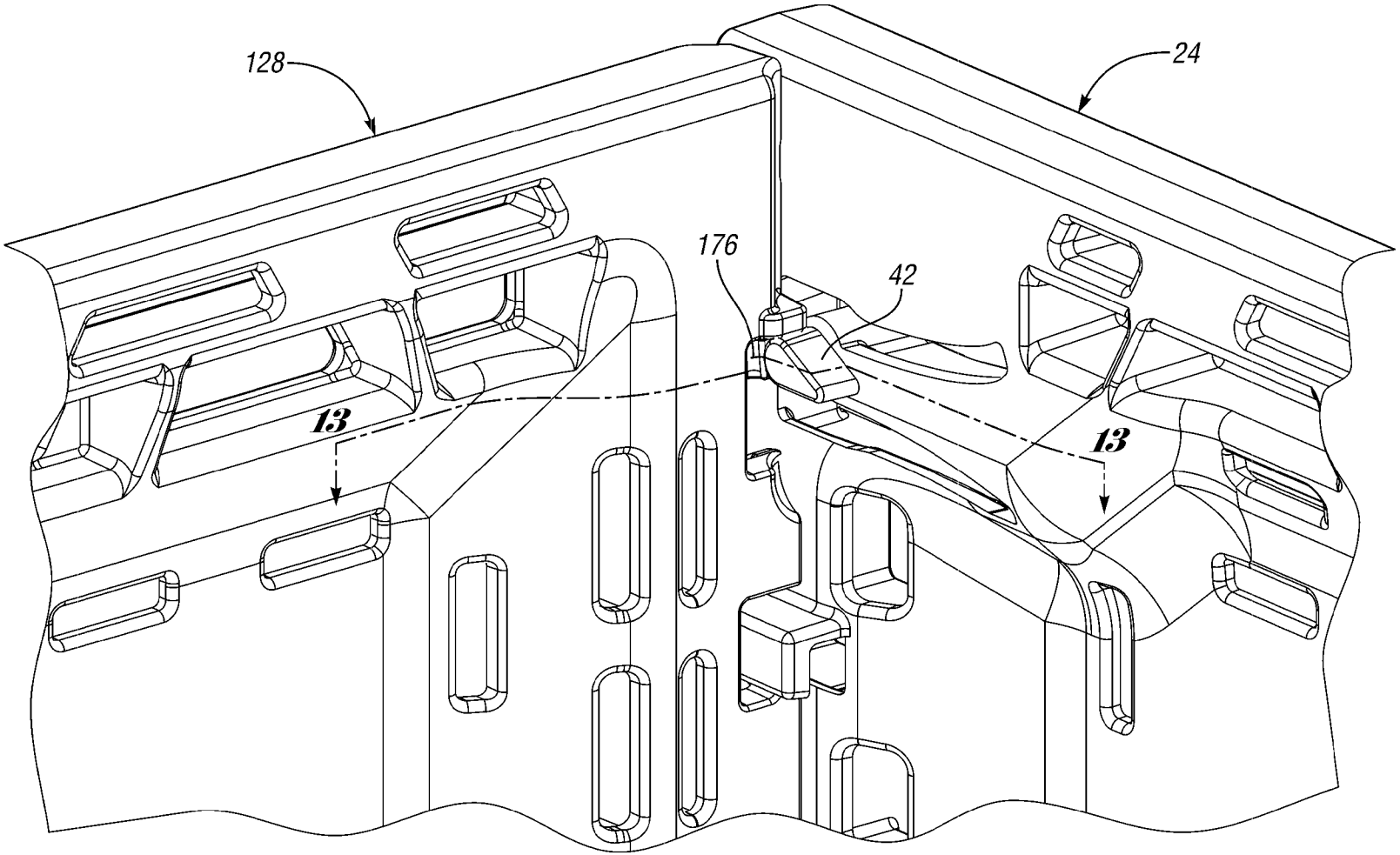
FIG. 12 is an interior view of a container with the end wall of FIG. 10.
Figure 13:
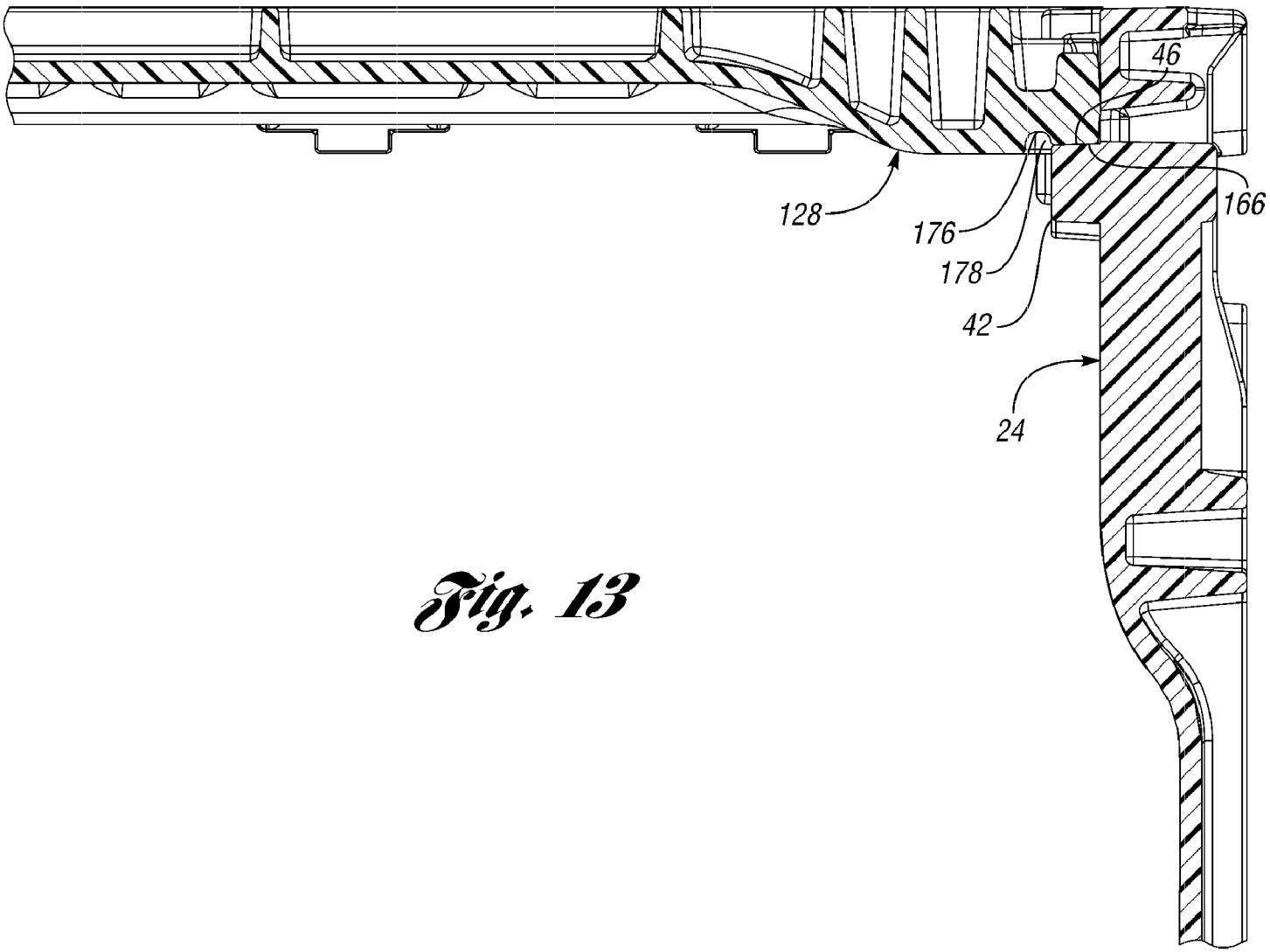
FIG. 13 is a section view taken along line 13-13 of FIG. 12.

FIG. 12 is an interior view of the alternate end wall 128 adjacent the side wall 24. FIG. 13 is a section view taken along line 13-13 of FIG. 12. Referring to FIGS. 12 and 13, the latch member 42 abuts the rearward ramped surface 166 adjacent the pocket 176 and the bevel surface 178. When a knockdown force is applied to the center of the end wall 128, the wall may bow inward. This would cause the corner of the second rounded surface 46 of latch member 42 to be received in the pocket 176, without the latch member 42 binding with the rearward ramped surface 166. The second rounded surface 46 bears against the bevel surface 178, which is still oriented relative to the second rounded surface 46 to cause the latch member 42 to move downwardly to release.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. There are many different configurations for collapsible containers (knockdown or manually releasable) and variations in design, many of which would benefit from the present invention. Alphanumeric identifiers on method steps are for convenient reference in dependent claims and do not signify a required sequence of performance unless otherwise indicated in the claims.

What is claimed is:

1. A collapsible container comprising:

a base;

a first wall generally perpendicular to the base when in an upright position;

a second wall pivotably connected to the base and pivotable between an upright position generally perpendicular to the base and a collapsed position generally parallel to the base; and a latch protruding laterally from the first wall and engaging an engagement surface of the second wall when the second wall is in the upright position, the latch deflectable relative to the first wall in a direction generally parallel to a plane of the first wall to selectively disengage the latch from the second wall, the latch including a convexly rounded surface engaging the engagement surface when the latch is latched.

2. The collapsible container according to claim 1 wherein the engagement surface includes a ramped surface engaging the convexly rounded surface when the latch is latched.

3. The collapsible container according to claim 2 wherein the latch is deflectable upon an application of a knockdown force on the second wall such that the ramped surface engagement with the rounded surface causes the deflection of the latch to release the latch and permit the second wall to pivot toward the base.

4. The collapsible container according to claim 3 wherein the latch is deflectable in a direction generally perpendicular to the base to release the second wall from the upright position.

5. The collapsible container of claim 4 wherein the latch protrudes inward of the container from a cantilevered arm in the first wall.

6. The collapsible container according to claim 1 wherein the ramped engagement surface is a second ramped surface and wherein the latch further includes a first ramped surface that engages a first ramped surface on the second wall as the second wall is moved toward the upright position.

7. The collapsible container according to claim 1 wherein the latch is selectively manually actuatable to release the second wall from the upright position.

8. The collapsible container of claim 1 wherein the latch protrudes inward of the container from a cantilevered arm in the first wall.

9. A collapsible container comprising:

a base a first wall generally perpendicular to the base when in an upright position;

a second wall pivotably connected to the base and pivotable between an upright position generally perpendicular to the base and a collapsed position generally parallel to the base;

a latch protruding laterally from the first wall and engaging an engagement surface of the second wall when the second wall is in the upright position, the latch deflectable in a direction generally parallel to a plane of the first wall to selectively disengage the latch from the second wall, at least one of the latch and the engagement surface including a rounded surface engaging the other of the latch and the engagement surface when the latch is latched;

wherein the other of the latch and the engagement surface includes a ramped surface engaging the rounded surface when the latch is latched; and a recess inward of the ramped surface and immediately adjacent the ramped surface.

10. The collapsible container of claim 9 further including an angled bevel between the recess and the ramped surface.

11. A collapsible container comprising:

a generally planar base;

a first wall generally perpendicular to the base when in an upright position;

a second wall pivotably connected to the base and pivotable between an upright position generally perpendicular to the base and a collapsed position generally parallel to the base; and a latch on the first wall, the latch having a forward ramp surface and a rearward convex surface, the second wall engaging the forward ramp surface to deflect the latch relative to the first wall in a first direction generally parallel to a plane of the first wall as one of the first wall and the second wall is raised to the upright position, the rearward convex surface engaging the second wall in the upright position to retain the one of the first wall and the second wall in the upright position.

12. The collapsible container according to claim 11 wherein the latch is deflectable in a first direction generally parallel to a plane of the first wall to release the second wall from the upright position.

13. The collapsible container of claim 11 wherein the latch protrudes inwardly from the first wall.

14. A collapsible container comprising:

a generally planar base;

a first wall generally perpendicular to the base when in an upright position;

a second wall pivotably connected to the base and pivotable between an upright position generally perpendicular to the base and a collapsed position generally parallel to the base;

a latch on the first wall, the latch having a forward ramp surface and a rearward convex surface, the second wall engaging the forward ramp surface to deflect the latch in a first direction generally parallel to a plane of the first wall as one of the first wall and the second wall is raised to the upright position, the rearward convex surface engaging the second wall in the upright position to retain the one of the first wall and the second wall in the upright position;

wherein the latch is deflectable in a first direction generally parallel to a plane of the first wall to release the second wall from the upright position; and wherein the second wall includes a first ramped surface and a second ramped surface, the first ramped surface of the latch engaging the first ramped surface of the second wall as the second wall is moved to the upright position, the second convex surface of the latch engaging the second ramped surface of the second wall when the second wall is in the upright position, the second ramped surface of the second wall engaging the second convex surface of the latch to deflect the latch to release the second wall from the latch upon the application of a knockdown force on the second wall.

15. The collapsible container according to claim 14 wherein the second convex surface is a rounded surface.

16. A collapsible container comprising:

a base;

a first wall;

a second wall perpendicular to the first wall and pivotably connected to the base, the second wall pivotable between an upright position generally perpendicular to the base and a collapsed position generally parallel to the base; and a latch protruding from a cantilevered arm of the first wall, the cantilevered arm movable within a plane that is substantially co-planar with that of the first wall, at least a first one of the latch and the second wall having a first ramped surface which engages the other of the latch and the second wall as the second wall is raised to the upright position, at least a second one of the latch and the second wall having a second convexly rounded surface which engages the other of the latch and the second wall when the second wall is in the upright position, the latch being deflectable by the second convexly rounded surface to release the second wall from the upright position upon the application of a knockdown force on the second wall.

17. The collapsible container according to claim 16 wherein the latch is deflectable by the first ramped surface as the second wall is moved to the upright position.

18. The collapsible container according to claim 17 wherein the latch is deflectable in a first direction generally parallel to a plane of the first wall to release the second wall from the upright position.

19. The collapsible container according to claim 16 wherein the first ramped surface and the second convexly rounded surface are both formed on the same one of the latch and the second wall.

20. The collapsible container according to claim 16 wherein each of the latch and the second wall include the first ramped surface, one of the latch and the second wall including the second convexly rounded surface, the other of the latch and the second wall including a second ramped surface, the first ramped surface of the latch engaging the first ramped surface of the second wall as the second wall is moved to the upright position, the second ramped surface engaging the second convexly rounded surface when the second wall is in the upright position, the second ramped surface engaging the second convexly rounded surface to deflect the latch to release the second wall from the latch upon the application of a knockdown force on the second wall.

21. The collapsible container of claim 16 wherein the latch is selectively manually deflectable by actuation of a tab formed on the cantilevered arm.

22. A collapsible container comprising:

a base;

a first wall pivotable between an upright position and a collapsed position;

a second wall pivotable between an upright position and a collapsed position;

a latch assembly connecting the first and second walls, the latch assembly including a cantilevered arm extending from the first wall in a first direction, a latch protruding from the cantilevered arm in a direction generally perpendicular to that of the first direction and configured for engaging a ramped surface of the second wall, a pocket formed in the second wall adjacent the ramped surface, the pocket between the ramped surface and a center of the second wall;

the latch deflectable relative to the first wall in a direction generally parallel to a plane of the first wall.

23. The collapsible container according to claim 22 wherein the latch includes a rounded surface engaging the ramped surface when the latch is latched.

24. The collapsible container of claim 22 further including an angled bevel between the pocket and the ramped surface.

25. The collapsible container of claim 23 wherein the pocket is capable of receiving a corner of the rounded surface of the latch, the latch releasable upon engagement of the corner of the rounded surface of the latch with the pocket.

* * * * *

UNITED STATES PATENT AND TRADEMARK OFFICE

CERTIFICATE OF CORRECTION

PATENT NO. : 7,641,066 B2
APPLICATION NO. : 11/761222
DATED : January 5, 2010
INVENTOR(S) : Kyle L. Baltz It is certified that error appears in the above-identified patent and that said Letters Patent is hereby corrected as shown below:

IN THE CLAIMS:

In claim 14, column 6, line 24, please delete "first ramped" and replace with --forward ramp--.

In claim 14, column 6, line 27, please delete "second" and replace with --rearward--.

In claim 14, column 6, line 30, please delete "second convex" and replace with --rearward convex--.

In claim 15, column 6, line 35, please delete "second" and replace with --rearward--.

Signed and Sealed this

First Day of June, 2010

David J. Kappos

David J. Kappos
*Director of the United States Patent and Trademark Office*